United States Patent [19]

Williams, Jr.

[11] Patent Number: 4,903,969

[45] Date of Patent: Feb. 27, 1990

[54] BOARD GAME APPARATUS

[75] Inventor: Justin C. Williams, Jr., Milwaukee, Wis.

[73] Assignee: George J. Chanos, San Diego, Calif.

[21] Appl. No.: 265,854

[22] Filed: Nov. 1, 1988

[51] Int. Cl.[4] ..... A63F 3/00

[52] U.S. Cl. ..... 273/248; 273/275; 273/282; 273/285; 273/291

[58] Field of Search ..... 273/275, 283, 284, 284, 273/258, 282 R, 291, 298

[56] References Cited

U.S. PATENT DOCUMENTS

| | | | |
|---|---|---|---|
| 2,162,876 | 6/1939 | Barton | 273/282 R |
| 2,531,510 | 11/1950 | Heacock | 273/258 |
| 2,732,211 | 1/1956 | Foster | 273/284 |
| 4,364,568 | 12/1982 | Tracy | 273/242 |
| 4,614,344 | 9/1986 | O'Conner | 273/283 |

FOREIGN PATENT DOCUMENTS

| | | | |
|---|---|---|---|
| 994883 | 8/1951 | France | 273/282 R |

*Primary Examiner*—Edward M. Coven
*Assistant Examiner*—Benjamin Layno
*Attorney, Agent, or Firm*—Bernard L. Kleinke; William Patrick Waters; Jerry R. Potts

[57] ABSTRACT

The board game apparatus includes a foldable game board having a substantially flat plane area when disposed in its playing position. The playing area is adapted for receiving removable game board pieces arranged by the players into various different pathways, over which are moved player position marking pieces during the play of the game. Moving the removable game board pieces over the playing area of the game board according to the rules of the game.

15 Claims, 1 Drawing Sheet

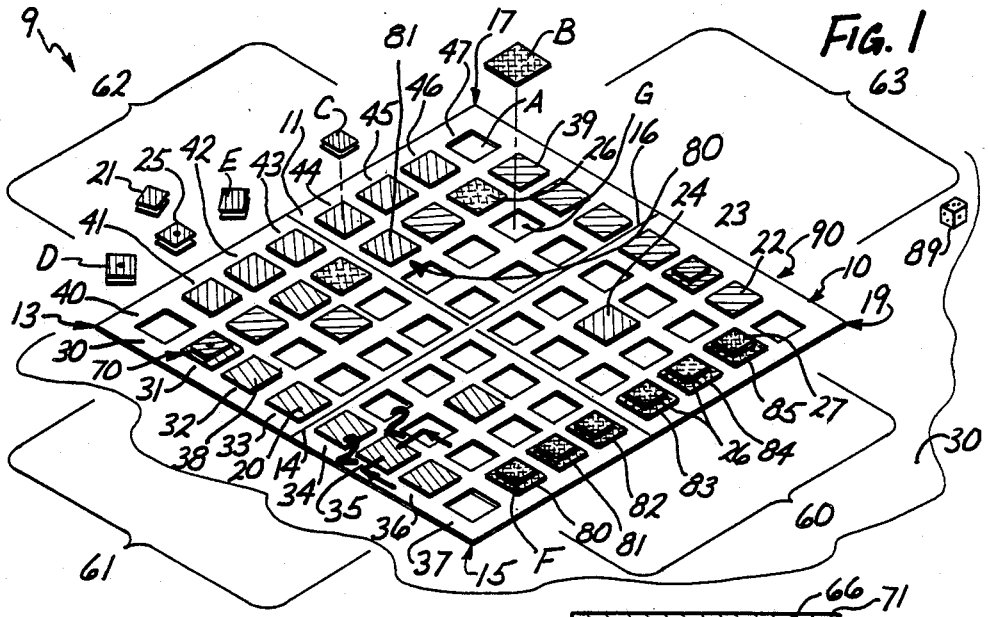
FIG. 1
9
62
63
81
17
B
47
46
A
G
11
C
45
39
26
16
80
21
25
42
E
43
44
24
23
22
90
10
89
41
D
40
13
19
30
70
31
32
38
33
20
14
34
35
36
37
15
F
80
81
82
83
26
84
85
27
60
61
30
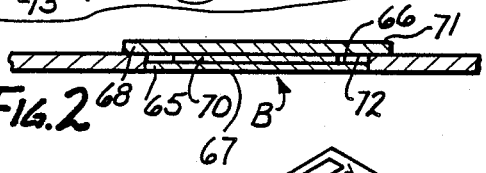
FIG. 2
66
71
68
65
70
B
67
72
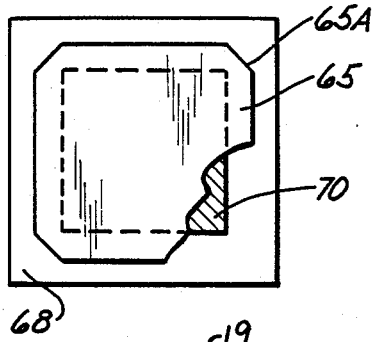
FIG. 3
65A
65
70
68
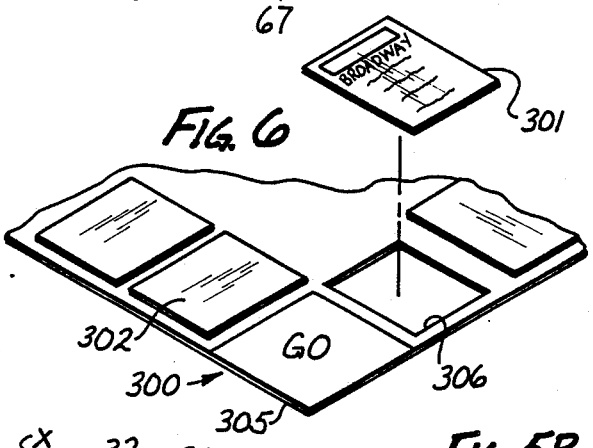
FIG. 6
BROADWAY
301
302
GO
300
306
305
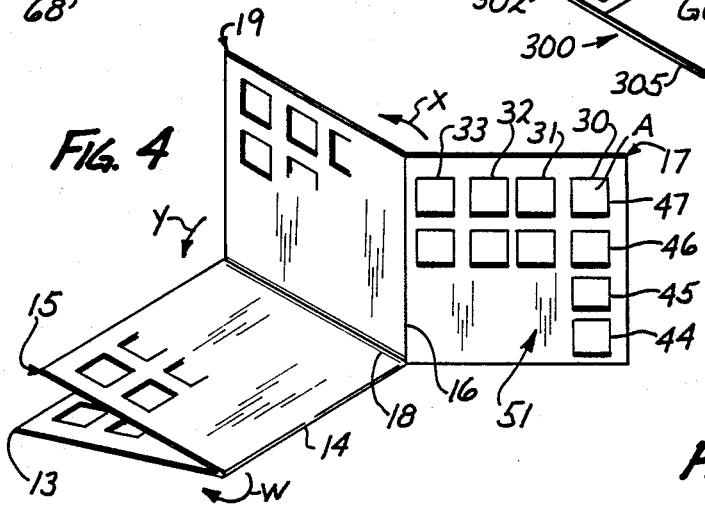
FIG. 4
19
X
33
32
31
30
A
17
47
46
45
44
Y
15
16
51
18
14
13
W
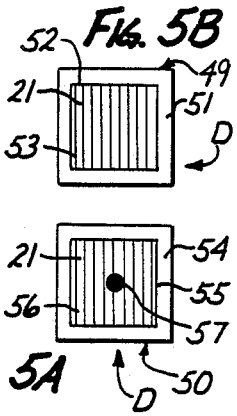
FIG. 5B
52
49
21
51
53
D
21
54
55
56
57
50
D
FIG. 5A

BOARD GAME APPARATUS

TECHNICAL FIELD

The present invention relates in general to a game, and it more particularly relates to a board game apparatus, which includes a game board, position marking pieces, and movable board pieces, as well as move determining devices.

BACKGROUND ART

There have been many different types and kinds of board games. For example, strategy board games have been used for both amusement and for stimulating player's thoughts, imagination and game playing skills. Such games have typically included a game board, and position marking pieces.

Other types and kinds of board games used for entertainment, as well as educational purposes, have also been known to stimulate the interest of users in various areas. For example, there is the well known game sold under the tradename "Monopoly", wherein a player by strategy and moving a position marking piece along a series of interconnecting squares, according to the roll of a die, attempts to acquire real estate monopolies and divest his or her opponents of their real estate holdings and cash assets. In this manner, the game is both an entertaining one, as well as an educational one, helping a player develop a playing strategy.

There are other types and kinds of board games. For example, reference may be made to the following U.S. Pat. Nos. 2,026,082; 3,759,521; 3,961,795.

Two other well known games, where players take turns in moving their position marking pieces along interconnecting squares, include the game of checkers and chess. In chess, for example, the game apparatus includes a game board with a square shaped playing area, subdivided into a series of columns and rows, along which the player's position marking pieces are moved. According to the rules of the game, players by complex game strategies, attempt to immobilize and capture their opponent's game playing pieces, until one or the other player wins by checkmating his or her opponent's king, or until a draw or stalemate results. Thus, by certain strategies made during the course of play, the players try to capture their opponents king to win the game.

While such games are entertaining, it would be highly desirable to have a board game apparatus which is simpler in format, and yet requires a substantial number of strategies for the players to achieve a winning position. In this regard, it would be highly desirable to have a game board apparatus that permits players to develop challenging game strategies, as they move their player position marking pieces along a board.

However, unlike chess or other such complex games, the rules and play of the game are easy to understand, and easy to play, even by the uninitiated. In this regard, it would be highly desirable to have a game board, which is of a unique and interesting design, to provide a stimulating experience for the players.

DISCLOSURE OF INVENTION

Therefore, it is the principal object of the present invention to provide a new and improved game, which is challenging to play.

Another object of the present invention is to provide such a new and improved game, which includes an intellectually challenging and highly entertaining game board of unique design.

Briefly, the above and further objects of the present invention are realized in accordance with the present invention, by providing a board game including a game board having a playing area thereon. A series of removable game board pieces define a set of changeable pathways on the playing area, along which the players move their player position marking pieces according to the rules of the game.

Thus, the inventive board game provides a new and challenging game that is intellectually challenging and highly entertaining. It is simple in format, with a substantial number of game strategies and variations of play.

In one form of the invention, the playing area of the game board is divided into a matrix of intersecting columns and rows. At each intersection of a row and column, a section of the game board playing area is removable and is interchangeable with any other removable section of the game board, where a row and column intersect. The removable game board pieces are divided into four equal groups, each group being distinguishable from another group by its color, so that changeable pathways of travel are defined by interconnecting removable game board pieces bearing the same color coding.

In operation of the matrix game, prior to the play of the game, each of four game players is given a set of sixteen removable game board pieces that are placed on the playing area, where the column and rows intersect. Each player must place six of his or her sixteen game board pieces along one peripheral edge of the game board, leaving the two outside or corner matrix squares blank. Thereafter, the players alternate their turns and randomly place their remaining removable game board pieces within the remaining blank matrix squares, until the entire matrix is filled. Players then place their position marking pieces, which are color coded to match their respective removable game board pieces, on their six predetermined game board positions located along the peripheral edge of the game board.

Play is started by each player, in turn, moving a predetermined number of moves. During a player's move, a player may move one or more of his or her position marking piece along the removable game board pieces forming the game board pathways according to the rules of the game. Alternately, a player may interchange one or more of the unoccupied removable game board pieces to change the game board pathways. A player may also combine these moves and may elect to take all, or only a portion of, the predetermined number of moves to which he or she is entitled. The game is concluded when one player successfully maneuvers all of his or her position marking pieces from the starting row of the peripheral edge of the playing area to the opposite side of the game board and back to the starting row. For game concluding purposes, the starting row includes the outside matrix squares or corners of the game board, if such squares are occupied by a removable game board piece corresponding to the player's designated color code.

As a result, an interesting and challenging game is achieved. Moreover, as will be explained hereinafter in greater detail, the novel game board of the present invention may be utilized for other types and kinds of games.

BRIEF DESCRIPTION OF DRAWINGS

The above mentioned and other objects and features of this invention and the manner of attaining them will become apparent, and the invention itself will be best understood by reference to the following description of the embodiment of the invention in conjunction with the accompanying drawings, wherein:

FIG. 1 is a pictorial view of a game board apparatus constructed in accordance with the present invention;

FIG. 2 is an enlarged sectional view of the game board apparatus of FIG. 1, taken substantially on line 2—2 thereof;

FIG. 3 is a greatly enlarged, fragmentary bottom plan view of one of the removable game board pieces of FIG. 1;

FIG. 4 is a pictorial view of the game board of FIG. 1, illustrating it in the process of being folded into a compact storage configuration; and FIG. 5A is a reverse face view of one of the position marking pieces of the game apparatus of FIG. 1, and FIG. 5B is an obverse face view of the marking piece of FIG. 5A; and FIG. 6 is a fragmentary, pictorial view of another board game apparatus, which is also constructed in accordance with the present invention.

BEST MODE FOR CARRYING OUT THE INVENTION

Referring now to the drawings, and more particularly to FIG. 1 thereof, there is shown a foldable game board 10, which is part of a game apparatus 9 constructed in accordance with the present invention, and which is used in accordance with the method of the present invention.

The game board 10, when opened into its playing position (FIG. 1), is generally thin and flat. It has on its top face a generally square shaped playing area 11. The playing area 11 is divided into a matrix of a series of rows, such as rows 30–37, and of a series of columns, such as columns 40–47 to define a matrix 90. At each location on the playing area 11 where columns and rows intersect, such as at column 47 and 30, there is provided a matrix, generally indicated at 90, of 64 square shaped holes or openings, such as a hole A. A set of 64 removable game board devices, such as the device B, fit within individual ones of the holes, such as a hole G, which is illustrated in the process of receiving the device B.

As shown in FIG. 1, only some of the game board devices are shown positioned in the game board holes for illustration purposes. However, at the start of the play of the game, all the board devices are inserted by the players in corresponding holes in the board.

As best seen in FIG. 1, a set of 64 individually colored movable generally square-shaped position-marking pieces, such as pieces 80-85, are distributed among the players at the beginning of the game. The marking pieces are adapted to rest on board pieces of the same color, and are manually movable by the players from one game board device to another game board device, over the face of the board 10, according to the rules of the game.

A chance determining device in the form of a die 89 is provided as part of the game apparatus, to determine the number of moves of either the board devices, or the marker pieces. The moves of the game are performed by the players, according to the game rules, as hereinafter explained in greater detail.

As the game board matrix 90 is comprised of eight rows and eight columns, the playing area 11 includes the 64 square-shaped openings or holes, such as the hole A, and the 64 square-shaped removable devices, such as the device B. The 64 game board devices are divided into four groups of sixteen devices each. The device groups are distinguishable, one group from another, by their respective color indicia, such as red indicia 20, green indicia 22, blue indicia 24 and yellow indicia 26. The color indicia 20, 22, 24 and 26 on the top face of the removable game board devices, define a plurality of changeable pathways of travel within the playing area 11 of game board 10.

A changeable pathway of travel includes one or more adjacent removable game board deices having the same color indicia. In this regard, according to the game rules, the playing pieces assigned to a given player may only be moved from one board piece to the next, bearing a certain color indicia. Additionally, a player is permitted to interchange board devices, and thus change the pathway of travel for opposing players.

One of the groups of devices comprises devices each bearing red indicia 20, a second group of the devices each bear green indicia 22. A third group of the devices each bear blue indicia 24. A fourth group of the devices each has yellow indicia 26. It should be understood that although in the preferred form of the invention, the game rules for the game apparatus 9 specify that the game can be played by four players, the game may also be played by a fewer number of players, such as two players. It will also become apparent to those skilled in the art that a fewer or greater number of board game devices may be employed. In this regard, smaller or larger sized matrices may also be employed.

The twenty-four position marking player pieces, such as the piece C, are divided into four groups of six marking pieces each. The player piece groups are distinguishable, one group from another, by their color indicia 21, 23, 25 and 27, which correspond to the group color indicia 20, 22, 24 and 26 associated with the removable game board devices, such as device B. The first group of pieces bear red indicia 21, and the second group of pieces have green indicia 23. A third group of pieces have blue indicia 25, and a fourth group of pieces bear yellow indicia 27.

Considering now the game board 10 in greater detail with reference to FIGS. 1 and 4, the game board 10 includes four quarter sections 13, 15, 17 and 19. As best seen in FIG. 1, the section 13 is hingedly connected at its edge to the adjacent edge of the section 15 by a hinge 14. The hinge 14 enables the section 13 to be swung from its flat planar use position (FIG. 1), into mating overlying engagement with the section 15 (FIG. 4) as indicated by the curved arrow W. In a similar manner, an edge of the section 17 is connected swingably to an adjacent edge of the section 19 by a hinge 16. The hinge 16 enables the section 17 to be swung out of the planar use position (FIG. 1) toward a position of mating engagement with the section 19, as indicated by the arrow X of FIG. 4. In this manner, the game board 10 may be folded in half.

As best seen in FIG. 4, another edge of the section 15 is hingedly connected to the section 19 by a hinge 18. The hinge 18 is mounted on the reverse side of the game board 10 between the adjoining edges of the sections 15 and 19, and perpendicular to the hinges 14 and 16. In this manner, when the section 13 is swung into overlying mating engagement with the section 15, and then the section 17 is swung into overlying mating engagement with the section 19, the sections 13 and 15 as a unit and the sections 17 and 19 as a unit may be swung in the direction of the curved arrow Y about hinqe 18, the sections 13, 15, 17 and 19 can be folded together to one quarter of the overall size of its opened flat playing position shown in FIG. 1.

Due to its foldable construction, the game board can be folded into a small, compact configuration for storage and transportation purposes. It should be understood that although in the preferred form of the invention, the game board 10 is foldable, a fixed or rigid flat game board may also be employed, in accordance with the present invention.

Considering now the sections 13, 15, 17 and 19 in greater detail, each one of the sections 13, 15, 17, and 19 are similar to one another and only one section, section 17, will now be described in greater detail. Referring now to FIGS. 1 and 4, the section 17 generally is an integrally formed smooth flat body section or sheet of uniform cross sectional thickness. The section 17 is generally square in face or plan view. The section 17 is subdivided into a series of rows, such as the rows 30 to 33 and a series of columns, such as columns 44–47 to define a sub-matrix generally indicated at 51 (FIG. 4) of the overall matrix 90. The sub-matrix 51 generally comprises sixteen individual and identical square holes, such as the hole A. Each hole, such as hole A, is adapted to receive removably one of the game board devices, such as device B.

It should be noted that the board pieces are interchangeable, in that each one of the pieces fit into any one of the holes in the board 10. Thus, the piece B can fit into any one of the holes, such as either the hole A or the hole G. This ability enablesthe players to remove the pieces and reinsert them into other board holes.

Considering now the removable game board devices in greater detail, the devices are similar to one another except for their color indicia, and only device B will now be described in greater detail. Referring now to FIGS. 1, 2 and 3, the device B generally includes a bottom square flange or plate 65 adapted to be received within any one of the holes in the board matrix 90. The flange 65 includes respective upper and lower surface 67 and 66. Each respective corner of the flange 65, such as corner 65A, is slightly beveled to facilitate insertion and removal of the flange 65 from a matrix hole, such as the hole A, of the game board 10.

A square top plate 68, having respective upper and lower surface 71 and 72, is fixed to the flange 65 in a spaced apart manner by a spacer block or plate 70. One side of the spacer plate 70 is rigidly secured to the upper surface 66 of the flange 65, while the opposite face of the spacer plate 70 is secured to the lower surface 72 of the plate 68.

The spacing between the flange 65 and the plate 68 is dimensioned so that when the device B is positioned within one of the holes, such as the hole A, the bottom surface of the plate 68 rests securely against, and overlies the upper surface of the playing area of the game board 10 surrounding the hole therein. The bottom surface of the flange 65 is positioned within the hole, and has its underside disposed flush with the underside of the board 10. In this position, the flange 65 rests on the underlying supporting surface 30 for the board 10.

The upper surface of the plate 66 includes a color indicia, such as indicia 20. In this manner, the device B may be easily distinguishable as being associated with one of the players of the game.

Considering now the changeable pathways in greater detail with reference to FIG. 1, up to a total of 64 board pieces may be randomly arranged within the playing area 11 during the play of the game. According to the rules of the game, as hereinafter described in greater detail, a predetermined set of pathways, such as the pathways generally indicated at 60, 61, 62 and 63, are initially established along the periphery of the playing area 12. The four pathways 60, 61, 62 and 63 are used to receive the four sets of marker pieces, which are adopted to rest individually thereon, such as the piece F resting on device 80. In addition, the players also establish a random number of additional pathways, at the commencement of the game. For example, a pathway 80 (FIG. 1) comprising similarly colored adjacent board pieces 45 and 81 form a pathway for the playing piece C. Thereafter, according to the rules of the game, the players may interchange board devices, such as devices 38 and 39, to establish new pathways and extinguish or block old pathways.

Considering now pathways 60, 61, 62 and 63 in greater detail, the peripherical pathways 60, 61, 62, and 63 are similar to one another, and only pathway 60 will now be described in greater detail. As best seen in FIG. 1, pathway 60 includes a row of adjacent devices 80, 81, 82, 83, 84 and 85. Each of the devices 80–85 are identical to one another, and each include color indicia 26 on their top surfaces. Each respective device, by its color coded indicia, defines a segment within the pathway 60.

As shown in FIG. 1, the pathway 60 includes the row of six board pieces extending along the periphery of the game board 10. It should be understood, therefore, that each color coded device establishes a single segment in any given pathway, and that the 64 devices, such as the devices 80–85, may be randomly repositioned by the players during the course of the game, according to the game rules.

Considering now the player marking pieces, such as pieces C, D, E, and F in greater detail, each one of the player marking pieces C, D, E and F are similar to one another, except for their individual color indicia, and thus only one of the pieces, will now be described in greater detail. Referring now to FIGS. 5A and 5B, the player marking piece D generally comprises a smooth flat body section of uniform cross sectional thickness, which is square in plan view. The player marking piece D has a front and back surface that includes indicia generally indicated at 49 and 50, respectively.

The indicia 49 includes a white border 51 that is square shaped and surrounds a black border 52, which is square shaped. The black border 52 surrounds a colored field or area 53, bearing a color indicia 21 matching the color indicia 20 of one of the groups of devices.

The indicia 50 is similar to the indicia 49, and includes a white border 54 that is square shaped surrounding a square shaped black border 55. The black border 55 surrounds a colored field or area 56 that also has a color indicia 21 matching the color indicia 20 at one of the groups of devices. An indicia 57 in the shape of a dot disposed approximately at the geometric center of the field 56 is used, according to the game rules, being faced upwardly during a return trip of the marking piece.

In accordance with the method of playing the present game, the players starting from a predetermined starting position with all their playing pieces positioned with their colored fields, such as field 49, facing upwardly and their dot indicia facing downwardly resting on the peripheral board pieces. The players manually move their pieces, such as the piece 27, from one board device to another, or alternately, they manually move and interchange the position of the board devices, such as devices 38 and 39, in accordance with a predetermined number of moves established in accordance with the rules of the game. As hereinafter described in greater detail, the players by interchanging devices establish changeable pathways along which their position marking pieces may travel from one peripheral edge of the game board 10 to an opposite, parallel peripheral edge of the game board 10.

When a player has manually moved one of his or her movable playing pieces to the opposite side of the board 10, the player manually turns over his or her playing piece to expose the indicia dot, such as indicia dot 57, to designate that the playing piece has traveled from one side marginal edge of the game board to the opposite side marginal edge of the game board. The players continue to move the devices and their pieces in accordance with the rules of the game, until one of the players has returned all their playing pieces to their starting side of the game board 10.

The player who is first to have all of his or her playing pieces returns to the starting side marginal edge of the board 10, wins the game.

To start the game, the players determine the order of play by any convenient method. Thereafter, each player in accordance with the order of play, chooses a playing color, and then places six of his or her sixteen devices in any six contiguous matrix holes starting from a center peripheral edge hole, and extending outwardly along the peripheral edge of the game board 10. Each player then randomly places his or her remaining devices in the remaining holes in the game board 10, one device at a time, each player in turn, until all remaining forty sixty holes are filled with devices.

Once all the devices have been placed on the playing area 12, each player places one of each of his or her movable playing pieces on the six contiguous devices corresponding to his or her playing color that are adjacent the peripheral edge of the game board.

Play then begins by the first player taking a number of moves in accordance with the roll of the die 89, as specified by the rules of the game. For example, if the 6 indicia of the die 89 comes to rest on the top of the die, the player rolling the die, is permitted to have six moves. With respect to the six moves, a player can make any desired combination of board device and marking piece moves.

While a die is shown and described herein, it should be understood that the game rules may also establish that each player will be permitted a predetermined number (e.g., 6) of moves each time. The player, instead of rolling the die, can move one or more of his or her playing pieces (as per the predetermined number) forwardly, backwardly or sidewardly, to adjacent board devices, by moving his or her pieces manually from one board piece to another. Alternately, the player may choose to exchange his or her unoccupied removable game board devices with the unoccupied game board devices of any of the opponents. Each exchange of devices counts as one of the predetermined number of moves.

The total number of moves to which a player is entitled, either the predetermined number, or the randomly selected number by the roll of the die, may be divided by the player among moving his or her playing pieces, or exchange removable game board devices, so long as the total number of combined moves, does not exceed the predetermined number of allowed moves. A player may also elect to take fewer than the number of allowed moves. For example, if six moves are allowed, the player could decide to take no moves; to move three pieces two positions each; to move one piece five positions, and exchange one pair of devices; or any combination of device and piece moves totally no more than six.

According to the game rules, a player can move forwardly and backwardly, in a straight line, or leftwardly and rightwardly in a straight line. The player may not move his or her position markers pieces diagonally on the game board 10, or over the unoccupied devices of the other players. Also, marking pieces may not occupy an unoccupied device of another player, or another occupied device, whether it be of his or her playing color or that of an opponent's playing color. Thus, at the end of any player's turn, there may be only one playing piece on each device, and every playing piece must be on a device corresponding to the playing piece's color.

Once a player has successfully moved one of his or her playing pieces to the opposite side of the game board 10 from the initial starting row position, the player is required to turn his or her playing piece over to its reverse side, to expose the dot indicia, such as indicia 54, to view. In this manner, that particular playing piece is designated, via the dot, that it is on a return trip to its starting row.

As soon as a playing piece reaches a board device in its starting row, which includes any device on the periphery of the game board, the player must remove that playing piece from the playing area 12. If another player's piece is occupying a device of its own color in the starting row of the player whose turn it is to move, the player whose turn it is to move, may move his playing piece into the opponent's occupied device, and then remove his own position marking piece from the playing area 12 of the game board 10. The first player to remove all six of his position marking pieces from the game board 10 wins the game.

In general, in view of the foregoing discussion of the game rules, a changeable or moveable pathway is defined as being a series of continuous unoccupied board devices of the same color indicia, interrupted, if at all, by one or more occupied devices of a different color indicia. In this regard, a player can advance his or her playing pieces along a pathway which includes occupied differently-colored devices, and can skip or "jump" over such occupied devices.

It should be understood that the game rules can be modified, or different rules may be used in connection with the game apparatus of the present invention. In this regard, for example, the playing pieces may be permitted to be moved diagonally as well. Also, the novel game board of present invention may be useful in playing conventional games, such as chess and checkers.

Referring now to FIG. 5, there is shown another game board apparatus 300, which is also constructed according to the present invention. The game 300 is arranged to play the well known game sold under the tradename "MONOPOLY".

The game apparatus 300 includes all of the playing pieces for playing the game of "MONOPOLY", including an inventive game board 305, having a series of removable board devices, such as a "BOARDWALK" property board device 301, which are adapted to be fit into a series of board holes or openings, such as the complementarily shaped hole 306. The board and board devices are constructed in a similar manner as the board and devices of FIG. 1, except that the game board 305 is arranged as a MONOPOLY game.

By appropriate modificaiion to the rules of the standard MONOPOLY game, a revised or modified version of the game of MONOPOLY can be played, wherein the properties, such as property device 301 could be interchanged with another property device, such as the property device 302.

While particular embodiments of the present invention have been disclosed, it is to be understood that various different modifications are possible, and are contemplated, within the true spirit and scope of the appended claims. For example, while manually manipulated game board, board devices and player position marking pieces are disclosed herein, it will become apparent to those skilled in the art that a video game may also be employed according the present invention, wherein images of the game board, board devices and marking pieces may be displayed and moved electronically by the players. Alternatively, the images may be displayed photographically, by, for example, the use of slide projectors, or the like. There is no intention, therefore, of limitations to the exact abstract or disclosure herein presented.

What is claimed is:

1. A game apparatus comprising:

four groups of movable game board pieces, each group being distinguishable one from another, each of said pieces including means defining indicia thereon, each one of said pieces of any given group having similar means defining indicia to identify them as forming a part of said given group, each one of said pieces of the other groups of said movable game board pieces including similar means defining indicia to identify them as forming a part of such other groups, said means defining indicia of each of the four groups being distinguishable from each of the other groups so that each one of the movable game board pieces of the same group are arrangeable to form changeable pathways of travel according to the rules of the game;

a game board having a playing area, said game board playing area being subdivided into four separate quadrants, each quadrant being rectangularly shaped for adjoining other quadrants;

each quadrant of said game board playing area being arranged in an equal number of columns and rows;

said columns and rows including means defining subdivisions, each one of said means defining subdivisions being constructed to receive any one of the movable game board pieces of any one of said groups;

each one of said movable game board pieces having on the front side thereof only a single element for forming a segment of the changeable pathway of travel and having on the rear side thereof only a single means for engaging an individual board subdivision, each group of movable game board pieces having the same number of pieces as every other group of movable game board pieces;

four groups of movable position marking player pieces, each group being distinguishable one from another and movable along selected ones of said movable game board pieces, each of said player pieces having front and reverse sides, each one of said player pieces of any given group having similar front means defining indicia on its front side to identify it as forming a part of said given group, each one of said player pieces of any given group having similar rear means defining indicia on its reverse side and corresponding to its front means defining indicia to further identify it as forming a part of said given group, said front and rear means defining indicia of each player piece of a given group corresponding to a corresponding one of said means defining indicia of a corresponding one of the groups of movable game board pieces, said front and rear means defining indicia of each of the four groups being distinguishable from each of the other groups, each corresponding group of player pieces and game board pieces having similar means defining indicia thereon being associated collectively with an individual player of the game and being moved by their associated player according to the rules of the game;

each one of said player pieces being movable substantially only on its own corresponding game board pieces having similar means defining indicia according to the game rules;

move determining means having means defining at least one numerical indicia for determining either the move of the player pieces to count as moves along selected ones of said movable game board pieces defining a pathway of travel, or to count as moves the interchanging a pair of selected ones of said movable game board pieces of different groups among the game board area subdivisions for changing a pathway of travel, according to the rules of the game each one of said player pieces having progression indicia means fixed to its reverse side for determining its path progression when exposed to view according to the game rules.

2. A game apparatus according to claim 1 wherein said game board includes a first game board section configured in the shape of a rectangle, said first game board section having front and back surfaces;

a second game board section configured in the shape of a rectangle, said second game board section having front and back surfaces;

a third game board section configured in the shape of a rectangle, said third game board section having front and back surfaces;

a fourth game board section configured in the shape of a rectangle, said fourth game board section having front and back surfaces;

first means for connecting hingedly the front surfaces of two of said game board sections so that said game board sections may be folded together with their front surfaces facing one another;

second means for connecting hingedly the front surfaces of the other two game board sections so that said game board sections may be folded together with their front surfaces facing one another;

third means for connecting hingedly the rear surface of one game board section whose front surface is hingedly connected by said first means to the rear surface of one game board section whose front surface is hingedly connected by said second means so that the rear surfaces of said game board sections are adjacent to one another when said game board sections are folded together; and wherein said individual sections are folded together so that said sections can be moved into a folded position with the sections facing one another for storage purposes.

3. A game apparatus according to claim 1, wherein said progression indicia means is fixed at the geometric center of each one of said player pieces.

4. A game apparatus according to claim 3, wherein said progression indicia means is generally in the shape of a dot disposed approximately at the geometric center of the means defining indicia.

5. A game apparatus according to claim 1, wherein said move determining means is a die.

6. A game apparatus according to claim 1, wherein said move determining means includes numerical indicia.

7. A game board apparatus according to claim 1, wherein said single element for forming a segment of a changeable pathway include color indicia.

8. A game board apparatus according to claim 1, wherein each one of said movable position marking player piece is generally a rectangularly shaped smooth flat body section of uniform cross sectional thickness with a front and back surface, each surface including color indicia thereon.

9. A game board apparatus according to claim 8, wherein one of said element includes position indicia for designating according to the game rules progression along said pathway of travel.

10. A game board apparatus according to claim 1, wherein said single means for engaging an individual subdivision includes a flange adapted to be received within any one of the means defining subdivisions.

11. A game board apparatus according to claim 10, wherein said flange has a plurality of corners, each corner being beveled to facilitate insertion and removal of the flange from a means defining subdivisions.

12. A game board apparatus according to claim 11, wherein said flange is attached to a block, said block being rigidly connected to a plate having an upper and lower surface, said flange and said plate being parallel and spaced-apart.

13. A game board apparatus according to claim 12, wherein the spaced-apart distance between said flange and said plate is dimensioned so that when the game board piece is inserted in said means defining subdivisions, the lower surface of the plate rests securely against and overlies the upper surface of the playing area of said game board.

14. A game board apparatus according to claim 13, wherein the upper surface of said plate includes said means defining indicia.

15. A game board apparatus according to claim 14, wherein said means defining indicia is color indicia.

* * * * *

UNITED STATES PATENT AND TRADEMARK OFFICE

CERTIFICATE OF CORRECTION

PATENT NO. : 4,903,969

DATED : February 27, 1990

INVENTOR(S) : Justin C. Williams, Jr.

It is certified that error appears in the above-identified patent and that said Letters Patent is hereby corrected as shown below:

Column 4, line 17, after "board", delete "deices", and substitute therefor --devices--.

Column 5, line 6, after "about", delete "hinqe", and substitute therefor --devices--.

Column 5, line 38, after "ability, delete "enablesthe", and substitute therefor --enables the--.

Signed and Sealed this

First Day of February, 1994

Bruce Lehman

*Attest:*

BRUCE LEHMAN

*Attesting Officer*

*Commissioner of Patents and Trademarks*